US005531048A

United States Patent [19]

Darling

[11] Patent Number: 5,531,048

[45] Date of Patent: Jul. 2, 1996

[54] STEP FOR A STAIRWAY AND METHOD FOR MAKING SAME

[75] Inventor: Gary L. Darling, Grandville, Mich.

[73] Assignee: Primary Millwork, Grand Rapids, Mich.

[21] Appl. No.: 331,963

[22] Filed: Oct. 31, 1994

[51] Int. Cl.[6] ..... E04F 11/16

[52] U.S. Cl. ..... 52/188; 52/182; 52/183; 52/191

[58] Field of Search ..... 52/182, 183, 188, 52/191

[56] References Cited

U.S. PATENT DOCUMENTS

| | | | |
|---|---|---|---|
| 606,532 | 6/1898 | Furness | 52/182 |
| 718,821 | 1/1803 | Cooper . | |
| 884,408 | 2/1807 | Schachner . | |
| 1,921,781 | 8/1933 | Sachs . | |
| 2,220,898 | 11/1940 | Franklin | 52/188 |
| 2,696,027 | 12/1954 | Ryland . | |
| 2,758,044 | 8/1956 | Terry . | |
| 2,847,732 | 8/1958 | Hyman . | |
| 2,881,485 | 4/1959 | Hyman . | |
| 3,552,084 | 1/1971 | Cormier . | |
| 3,895,981 | 7/1975 | Tesch . | |
| 3,909,997 | 10/1975 | Eickhof . | |
| 4,205,107 | 5/1980 | Jaschke et al. . | |
| 4,226,065 | 10/1980 | Jagemann . | |
| 4,321,293 | 3/1982 | Naka . | |
| 4,322,927 | 4/1982 | Scott . | |
| 4,464,870 | 8/1984 | Crepeau . | |
| 4,652,477 | 3/1987 | Rindfleisch et al. . | |
| 4,722,164 | 2/1988 | Scholler . | |
| 4,730,425 | 3/1988 | Young . | |
| 4,783,939 | 11/1988 | Bergmann et al. . | |
| 4,942,084 | 7/1990 | Prince . | |
| 4,985,095 | 1/1991 | Riddle . | |
| 5,051,289 | 9/1991 | Riddle . | |
| 5,088,247 | 2/1992 | Young . | |
| 5,163,491 | 11/1992 | Smith . | |
| 5,347,774 | 9/1994 | Smith | 52/191 X |

FOREIGN PATENT DOCUMENTS

| | | | |
|---|---|---|---|
| 0061707 | 10/1982 | European Pat. Off. | 52/182 |
| 3725422 | 2/1989 | Germany | 52/182 |
| 12799 | 6/1896 | United Kingdom . | |
| 61707 | 6/1982 | United Kingdom . | |
| 224918 | 10/1987 | United Kingdom . | |
| 2196035 | 4/1988 | United Kingdom | 52/182 |
| 3725422 | 2/1989 | United Kingdom . | |
| 3907959 | 9/1990 | United Kingdom . | |
| 515720A1 | 5/1991 | United Kingdom . | |
| 540954A1 | 5/1993 | United Kingdom . | |

*Primary Examiner*—Wynn E. Wood
*Assistant Examiner*—Glenn Edwards
*Attorney, Agent, or Firm*—Price, Heneveld, Cooper, DeWitt & Litton

[57] ABSTRACT

A method is provided for manufacturing or converting a stairway made from wood-composite materials to a stairway which appears for all intents and purposes to be made from architectural solid wood materials. The method contemplates providing one or more stair treads and risers interconnected on one or more support stringers. This assembly may be preexisting or constitute new construction. With the stair treads and risers in place, sheets of veneer overlay are provided which are scribed and trimmed to cover at least the end portions of each tread, riser, or both, leaving the central high traffic portion of the tread exposed. Once trimming is complete, the veneer overlays are adhered to each tread or riser. With respect to the stair treads, it is preferred that a portion of the veneer is rolled around the leading edge of the tread and fastened to the underlying surface. Any irregularities or gaps in the joints between the treads, risers, and veneer may be concealed behind strips of molding. Additional trim pieces are provided where the ends of the treads are opened or exposed, as opposed to being concealed between walls and/or trim stringers. The invention also provides for a kit for making a staircase appear as if it were made from architectural woods as well as the staircase including these components. Portions of the stairway where the composite wood materials remain exposed may be concealed by carpet runners or the like.

26 Claims, 1 Drawing Sheet

STEP FOR A STAIRWAY AND METHOD FOR MAKING SAME

FIELD OF THE INVENTION

This invention relates to stairways and, in particular, to a stairway step having the appearance of architectural wood, and a method for making stair steps to appear as if made from architectural wood.

BACKGROUND OF THE INVENTION

Stairways or steps have been made from a variety of materials particularly suited for the stairway environment. For example, steel and concrete stairways have been constructed for commercial or industrial applications while wooden stairways are preferred in residential applications. Wooden stairways may be fabricated from expensive architectural or solid woods, such as oak, maple, or cherry, and stained to produce a natural, rich appearance, or they may be made from less-expensive, wood-composite materials, such as plywood, particle board, or the like. Typically, stairways made from wood composites are covered by carpet or painted when located in high-visibility areas and are untreated when located in low-visibility areas, such as basements, cellars, or the like.

Although architectural and wood-composite stairways provide the same function, there is a dramatic difference in the cost of materials simply because architectural woods are not as abundant as composite materials. Labor costs are also more expensive when using architectural woods because the fit and finish must be much more precise. The disadvantage of wood-composite materials is that they do not provide as good a finish surface as architectural woods. A disadvantage with both materials is that of making repairs to damaged areas or steps, although the appearance of such repairs is often less critical in wood-composite stairways. If a particular step made from architectural wood is worn, repair of that step is difficult without substantially replacing the tread. Fillers and cements may not be suitable to resurface the step since coloring of such materials may not match the color of the wood nor accept a stain.

A particle-board tread is commercially available with a factory-applied veneer on the ends for use on stairways having a carpet runner. However, the tread is only made available in standard size. To shorten the length of the tread to fit a particular stairway dimension, the carpenter or installer must cut the tread in half in order to remove the required amount of material from the center of the tread, thus avoiding removing the factory-applied veneer from one or both ends of the tread. The two stair tread pieces must then be reassembled and joined over the center support stringer. Additionally, the ends of the tread must be cut at the job site order to provide a proper fit of the stair tread end against the lateral support stringers or wall. Typically, such trimming is done by a power saw, which results in tearing and gouged of the veneer on the tread surface. Disadvantages associated with this tread include the possibility that the joint at the center of the two tread pieces, when trimmed or reduced in size, do not overlay the center support stringer. Thus, to use the tread, the center support stringer will need to be increased in width or other support will need to be provided so the tread will provide a stable surface. Additionally, special precautions must be taken in order to prevent gouging or tearing of the factory-applied veneer when trimming the ends of the tread to conform with the lateral stringers or sidewalls of the stairway.

Currently factory-produced stair treads or steps must be stocked at the point of purchase to include different lengths ranging between 36 inches up to as much as 48 inches or more. This is due to the cost of solid wood material. Also, retailers must stock left return. treads and right return treads. Treads with both left and right returns must be specially ordered.

SUMMARY OF THE INVENTION

The instant invention provides an inexpensive and relatively simple way to rejuvenate existing stairway steps to like-new condition, or convert an existing stairway made from wood composite or other materials to appear as if made from architectural woods. Furthermore, the invention allows repairs of worn or damaged surfaces to be made without demolition of the stair step or stairway, and does not need large amounts of fillers and cements.

In one embodiment, a method is provided for making a stair step comprising the steps of providing at least one sheet of wood veneer specially configured to be adhered to at least a portion of the upper surface of the stair tread, and with very basic carpentry skills, closely conform the edges of the sheet to a stair riser or stringer and cover the stair tread, thus making it appear as if made from solid grain architectural wood. An adhesive pre-applied to one side of the wood veneer sheet retains the veneer in place. Additional features of this method include attaching a riser to the stair tread proximate either the front or rear edge, such riser either capable of receiving a similar sheet of wood veneer or being made from a wood composite material with a matching veneer surface. Trim pieces and other moldings are provided which can be attached to the stair tread and riser to conceal any irregularities produced as a result of installation. The method also provides for attaching solid wood end caps to any exposed end of the stair tread and riser in order to complete the appearance that the step is made from solid architectural wood.

Another embodiment or form of the invention includes a stair tread having upper and lower surfaces, a front edge, a back edge, and ends with at least one sheet of wood veneer adhered to the stair tread upper surface proximate each end and extending around the front edge and a portion of the lower surface.

Also included is a riser precut from a wood-composite material and covered on one side by a wood veneer. The riser extends from the rear edge of each tread on the stairway. Attached to the front of each tread over a joint with the underlying riser is one or more trim pieces provided to conceal any errors in trimming of the riser to the appropriate height and to retain in place a forward edge of the wood veneer sheet covering the stair tread. In instances where an end of the stair tread is open and exposed, a solid wood end cap is provided to cover the end of the tread and provide a more finished look. Additional trim pieces are provided, adapted to be located under the end cap to correspond with the trim under the leading edge of the tread and to conceal an exposed joint between the riser and the stair trim stringer.

Another form of the invention provides a kit for converting a newly constructed or existing stairway to appear as if made from solid architectural wood. Although intended for stairways made from wood-composite materials, the invention can be applied equally as well to stairways made from architectural wood. In its basic form, the kit includes one or more predimensioned sheets of wood veneer capable of covering at least portions of the stair tread upper surface, leading or forward edge, and lower surface. Preferably, the kit provides two sheets of wood veneer of sufficient size to cover the upper surface, leading edge, and a portion of rite lower surface proximate each end of the tread. An adhesive attached to one surface of the wood veneer by a polymeric backing is used to hold the veneer sheet in place on the tread. The portion of the stair tread not covered by the wood veneer can be concealed by a carpet runner. The kit also preferably includes trim pieces, such as moldings, to conceal any irregularities or mistakes made in construction of the stairway or in trimming the veneer to the proper length. Solid wood end caps can also be provided to cover the unfinished ends of any stair treads or risers which are visible.

The advantages provided by this invention include the ability to produce the elegant and rich appearance of an architectural wood stairway at less than half the cost. Additionally, installation is very forgiving and easy to perform, providing a further saving on time and labor during installation. Because building codes do not allow trim on the tread surfaces, the treads must fit exactly without gaps to have a good appearance. This time-consuming task, which requires a highly skilled tradesman, is eliminated by the use of the veneer overlay, which is easily cut to fit and covers any gaps at the tread edges and ends. Since the tread does not need to be removed, repairs can also be easily completed to damaged sections of veneer. Because real wood veneer is being used, the new veneer sheets accept stains and finishes in a consistent manner, unlike many fillers and cements. Moreover, the instant invention can be used on existing stairways as well as in new construction with the techniques and results being very consistent. The instant invention can be installed in the field, allowing the base treads and risers to be installed with less than a perfect fit, with the gaps being covered by the easily fitted veneer overlays trimmed by a utility knife or scissors.

An additional advantage is that the invention uses composite wood materials instead of solid hardwoods. As a result, the invention utilizes waste wood materials and conserves precious hardwood forest resources. Furthermore, the invention makes it possible for a beginner to provide a professional-looking work product.

Yet another advantage of this invention is that it reduces the retailer shelf stock to fewer items, resulting in less shelf space requirements while providing the full range of benefits to build left return and right return stair treads or treads having both left and right returns.

BRIEF DESCRIPTION OF THE DRAWING FIGURES

A better understanding of the invention and the advantages provided thereby may be obtained by reference to the specification and the attached drawing figures, wherein.

DETAILED DESCRIPTION OF THE VARIOUS EMBODIMENTS

Figure 1:
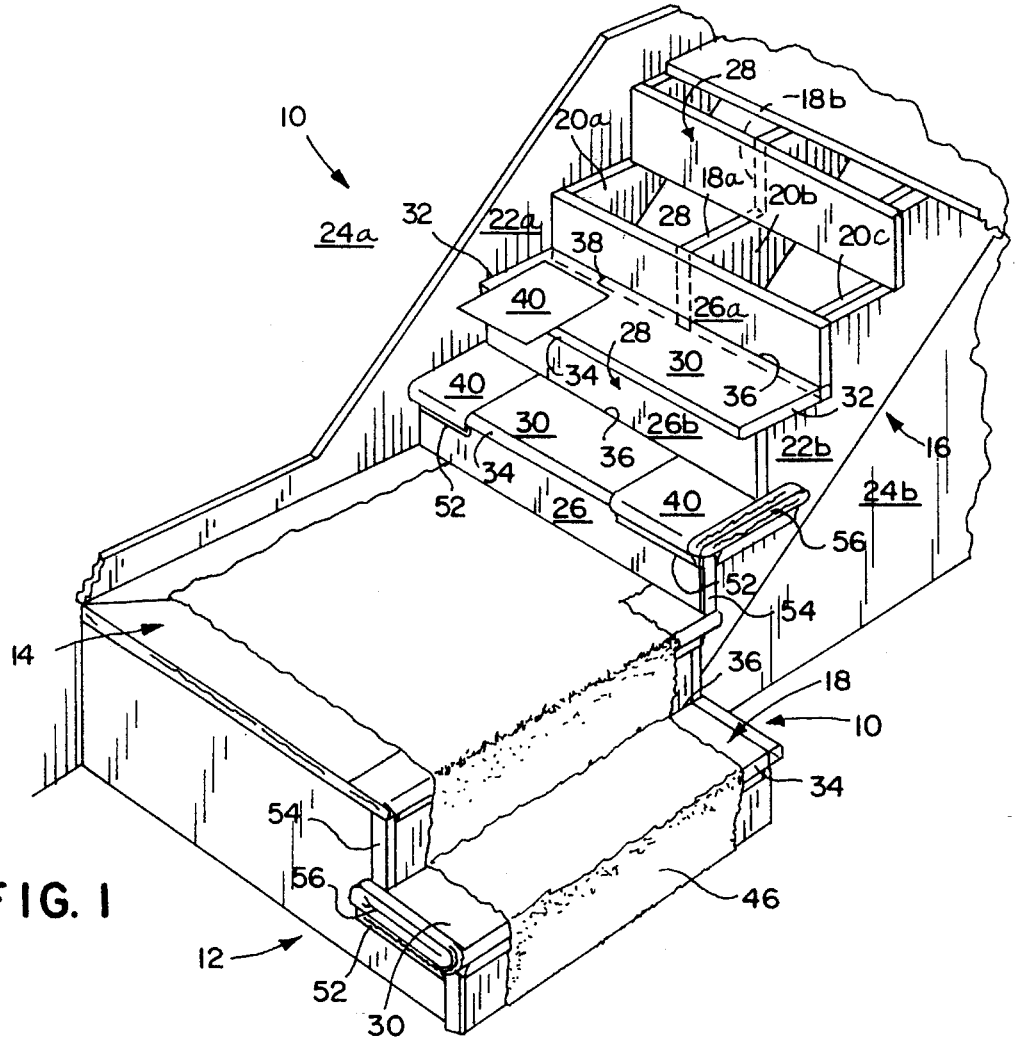
FIG. 1 is an oblique view of a stairway embodying the invention.
Figure 2:
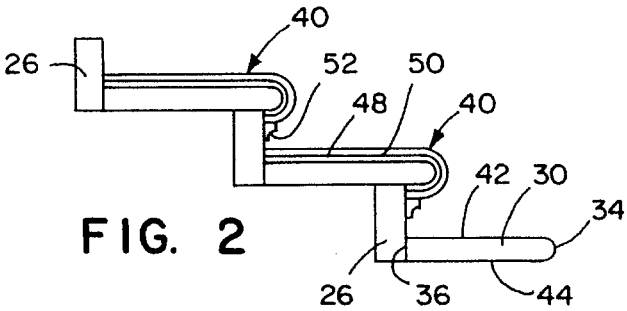
FIG. 2 is an elevational section view of two stair steps illustrating a wrap of the veneer around the leading edge of each tread.

One embodiment of a stairway made according to the invention is shown in FIG. 1. The stairway 10 includes a first flight of stairs 12 leading to a landing 14 and followed by a second flight of stairs 16. The number of steps and specific configuration of the stairway 10 will vary depending upon the particular requirement and the run and rise of the stairway. For a conventional straight stairway, the number of steps may range between eleven and fourteen.

A conventional stairway construction uses three support stringers 20*a*, 20*b*, and 20*c*, spaced equidistant from each other, and each including a tread 18*a* and riser 18*b* cut-formed to receive the respective steps. If desired, trim stringers, such as 22*a* and 22*b*, may be installed along finished walls 24*a*, 24*b* above and below the stairway, preferably before installation of the steps. Such stringers may be made from solid wood or wood-composite material covered with a vinyl or a paper product imprinted to give the appearance of real wood. Other materials including veneered plywood may also be used.

After any trim stringers have been installed, risers 26 are cut to length and located on the riser cuts 18*b* of the trim stringer 22*a*, 22*b* or cut to fit flush with the side of the trim/support back vertical face opposite each support stringer and by nails. It is preferred that the risers be made from wood composites such as particle board or plywood, although architectural solid wood stock may also be used. The wood-composite materials may be unfinished, but preferably have a wood veneer on one surface for reasons which will become apparent below.

Following the attachment of risers 26, the stair treads 30 are attached. It is preferred that the stair treads 30 are made from 1⅛ inch thick particle board cut 12 inches wide and 48 inches long. It is also preferred that each tread be trimmed to an overall width 1¼ inch greater than the distance between the finish faces 28 of the upper and lower risers 26*a*, 26*b*. The length of each tread 30 may also be trimmed such that the ends 32 are flush with trim stringers 22*a*, 22*b*. It is preferred, however, that the leading edge 34 of each tread 30 be rounded, as is often conventional in the industry. Each tread may be fastened in place to the support stringers 20*a*, 20*b*, and 20*c* by conventional construction adhesive and nails. Additional fasteners such as nails or screws may be used to attach the lower edge of the risers to the rear edge 36 of each tread.

The configuration outlined above is one example of stairway construction that may be used for either composite wood or architectural wood materials. Other stairway constructions are also suitable for this invention. Additionally, although wood-composite materials are preferred, existing stairways made from architectural wood showing signs of wear and abuse can provide a suitable substrate for the invention.

One embodiment of the invention contemplates providing at least one and preferably two overlay sheets of wood veneer 40 each having dimensions sufficient to cover at least a portion of the upper surface 42 of the tread 30 from a point flush with one end 32, back edge 36, and extending over the leading edge 34 to the lower surface 44. Sufficient veneer 40 is provided so that it may be trimmed flush with the facing surface 28 of the underlying riser 26. Although sufficient veneer may be provided to cover the entire upper surface of the tread, the central portion of each tread is preferably left exposed to be later concealed by a floor covering, such as a carpet runner indicated as 46.

For convenience and ease in installation, it is preferred that each sheet of veneer 40 include a self-adhesive, peel-and-stick backing 48, for example 3M Scotch Brand 468 MP HiPerformance Adhesive, used to fix each sheet 40 on the tread 30. The adhesive backing 48 includes a polymeric sheet 50 having one surface to receive the adhesive while the opposite side is bonded to the veneer 40. Alternatively, the sheets of veneer may be adhered using more conventional, separately applied adhesives. The dimensions of the sheets can vary depending upon the desired area to be covered. Sheet 40 may be cut to fit precisely flush with the end 32, back 36, and front 34 edges using conventional scribing techniques and trimmed by a utility knife or scissors. In a preferred embodiment, each sheet 40 is precut so that at least one edge of the sheet is straight to minimize later trimming.

To conceal any irregularities resulting from construction of the stairway treads and risers and to additionally provide a more rich appearance, trim pieces such as cove molding 52 are provided. In one embodiment, each length of molding 52 is generally the same as the width of the veneer sheet 40. It is contemplated that the molding 52 be attached to cover the underlying joint of riser 26 with stair tread 30 and securely retain the wrapped edge of the veneer overlay 40 to the bottom 44 of the tread 30. The cove molding 52 also conceals any gaps in the joint. In the event that the end of a stair tread is exposed, additional trim pieces are provided including an end cap 54 made from solid wood to hide the wood composite end and one or more moldings 56 to conceal any joint between the riser 26 and the trim stringer 22. End cap 54 is preferably made from solid wood with a length greater than tread 30 and a thickness substantially equal to the tread and wood veneer cover to provide a flush fit with the tread. It is further preferred that the end of the cap adjacent the leading edge of the tread have the same rounded profile. A strip of cove or other molding matching that on the face of the riser can be used to finish the underside of the end cap. All can be attached to the stairway by a combination of wood adhesive and finish nails or screws.

In a preferred embodiment of the invention, all of the components are provided in one or more kits so that a person with little carpentry skills can either build a stairway by purchasing exactly the number of steps required, with each step kit including the tread, riser veneer overlays, and trim pieces. Each package could be specifically designed for a step where the ends 32 of the tread 30 are concealed, either against a wall 24 or against a trim stringer 22. For example, one kit may include one particle board tread 30, a veneered plywood riser 26, a pair of matching wood veneer overlays 40, and a pair of cove moldings 52 for trim. A separate kit can be provided for each exposed end 32 of the tread 30, including an end cap 54, a molding 56 matching that on the face 28 of the riser 26, and an additional trim for concealing the joint between the riser 26 and the trim stringer 22. All of the components in the kits would predimensioned and have at least one straight edge to provide for a professional construction. In this manner, the user avoids calculations of board footage and can purchase all of the components in one or more packages.

The method for producing the stairway is normally done during the final trimming stages of new construction or remodeling. Basic framing is preferably completed before starting the installation process. It is also preferred that the stairwell opening be framed according to the plan and meet local code requirements. Moreover, it is preferred that there be a minimum of at least three support stringers 20*a*, 20*b*, 20*c* for proper step support. Finish stringers 22, also called trim stringers or skin boards, if used should be installed before beginning installation of the risers 26 and treads 30.

The method contemplates starting with the installation of the riser 26 starting at the bottom and working up toward the top of the staircase. The predimensioned riser 26 is preferably oversized so that it can be used in essentially any standard stairwell or staircase construction. If necessary, riser 26 may be cut to fit where the width matches the riser cut on the support stringers 20 or to fit snugly between the trim stringers 22. For open-ended steps, riser 26 should be trimmed to butt slightly against the wall side first, then with the open end 32 cut flush with the face of the trim stringer 22. A bead of construction adhesive is applied to the vertical faces of the support stringers 20, and nails are used to fix the riser in place. Because the preferred materials are a veneered plywood, the veneer surface 28 of the riser should face away from the support stringers 20.

Once risers 26 are in place, treads 30 are installed in a similar fashion, beginning with the bottom and working up toward the top of the stairway. Just as with the risers, treads 30 are cut to an overall width that is preferably 1¼ inches wider than the distance between the faces 28 of the upper and lower risers 26. Since treads 30 preferably have a rounded leading edge 34, any trimming should be done along the back edge 36. It is preferred that a bead of construction adhesive is applied to each support stringer 20 with tread 30 fastened in place by nails. Gaps may be provided between the ends 32 of the tread 30 and each trim stringer 22 to allow for expansion and contraction of the materials. The bottom edge of each riser 26 may be fastened to the back edge 36 of each tread 30 by nails or other fasteners, preferably driven through the back, lower edge of the riser into the tread.

Once treads 30 are installed, veneer overlays 40 are paired off to obtain the best color and grain match. In this manner, the exposed ends of the tread make it appear that the tread is formed from a single, solid piece of wood. Beginning with the bottom step, the veneer overlay 40 is fit into the corner formed by the riser 26 and the trim stringer 22, with the long edge of the veneer sheet 40 butted against the trim stringer 22. Any gaps between the stringer 22 and the overlay 40 may be removed by scribing a line parallel to the riser about ⅛ of an inch in from the edge where the gap is widest, and the overlay is trimmed to the scribe line. Sufficient material is preferably supplied so that if the trim is not perfect, it may be retried. Once trimming is complete, and with the protective adhesive backing still on the overlay, the overlay sheet is placed into the corner of the tread. While holding it in place, the veneer overlay 40 is wrapped around and under the leading edge 34 of the tread 30 and the veneer sheet is marked with a pencil about ⅛ of an inch short of the riser 26 to indicate the overall final length. The overlay is then placed on a flat wooden surface and cut as indicated above to the proper length.

Before attaching the veneer overlay 40, the tread surface should be clean, dry, and free of dust and dirt. No particles of the tread material should protrude above the tread surface around the nail holes, and all nail heads should be countersunk below the tread surface. Any raised portion of the tread underneath the overlay will telegraph through and show as a bump in the tread surface. Once the tread surface is clean, the protective backing is removed from the veneer sheet 40. The veneer sheet is applied to the tread 30 by placing the overlay back into the corner, fitting the edges tightly. The sheet is then lightly pressed in place, starting in the corner and working out along the trim stringer, making sure the fit is tight to both the riser and the trim stringer. If the fit is not right, the overlay may be pulled up and repositioned. Once the overlay is tightly positioned with the proper fit, the overlay is pressed down more, firmly, working simultaneously out toward the tread nosing and the inside edge of the overlay. Before overlay 40 is wrapped beneath the tread's leading edge 34, the entire top surface is pressed firmly to achieve secure adhesion. Overlay 40 is worked around the rounded leading edge 34, pulling on the front edge while also pulling the veneer surface, and around the front edge of the rounded nosing. The remaining veneer is pressed tightly to the flat underside 44 of the tread's leading edge. To ensure secure adhesion, heat may be applied to the veneer overlay using a standard household iron set at medium heat. This is preferably done after all of the overlays are in place and before the trim is installed.

Each kit preferably includes two pieces of ¾ inch×¾ inch×7½ inch cove trim 52 to cover the veneer under the tread's leading edge 34 and enhance the finished look of the staircase. Also, preferably included are two pieces of riser trim 56 measuring 3/16 inch ×¾ inch×7 inch that can be used to cover the riser ends, if desired. Each cove and riser molding 52, 56 may be installed using finish nails and wood adhesive in a conventional manner.

In instances where the ends of the treads are exposed, a kit is also provided which includes a solid wood end cap piece 54 having a thickness generally equal to that of tread 30 plus veneer overlay 40. The length of the end cap 54 is preferably longer than the width of the tread 30, with opposite ends rounded with a radius generally equal to that provided on the leading edge 34 of the tread. End cap 54 is installed by locating the end cap on the end 32 of the tread 30 such that the upper surface and one end is flush with the veneer overlay. End cap 54 may then be secured by finish nails or screws in a manner conventional in the trade. The finish nails or screw heads may be concealed using plugs or fillers. The area immediately below end cap 54 may also be finished using a cove molding identical to that provided on the facing surface 28 of each riser 26. Because this molding joins the molding on the riser at a right angle, it may be desired to miter the joint of the two ends. The molding is then attached beneath the end cap in the same manner as the molding is attached to the riser.

Following these procedures, stairway 10 is provided made primarily from wood-coposite materials with the exposed surfaces of the stairway concealed with veneer 40. The center or high traffic portion of the stairway is preferably concealed by a carpet runner or the like 46. Once completed, the stairwell appears to be made from architectural woods but at a fraction of the cost.

It is contemplated that the entire tread surface 42 may be covered by a veneer overlay. Given that the sheets of veneer 40 have a self-adhesive backing 48, installation can be achieved in the same manner as outlined above. If, after some usage the veneer is breached, or otherwise worn through, the veneer sheet overlay can be easily removed and replaced without the need to remove the entire tread. This same repair technique is applied equally as well to the embodiment wherein only the end portions of each tread receive the veneer overlay.

It is also contemplated that in the instances where the risers do not have a factory-applied veneered surface, veneer overlays substantially similar to those described with respect to the treads may be used to conceal the ends of the risers. In such situation, it is preferred that the veneer overlays are applied to the ends of the risers prior to application of the base tread overlays. In this fashion, the base tread overlays will butt against and at least partially conceal the veneer overlay applied to the risers giving no indication that the risers were installed after the base treads. It is contemplated that the installation procedures for preparing the surface of the riser and trimming or sizing each of the veneer overlay is substantially the same as that outlined above for the base tread overlays. In particular, it is preferred that prior to peeling the protective backing off the adhesive layer of the overlay, the veneer overlay is placed over the stair riser and oriented such that the grain is horizontal. An outside edge of the overlay is aligned with an end of the riser and slid downward until the bottom edge of the overlay contacts the stair tread or base tread surface. If a gap exists between the bottom edge of the overlay, a line is scribed on the overlay using conventional techniques making the scribe line parallel to the upper surface of the base tread. The veneer overlay is then trimmed and the fit is rechecked. If the overlay aligns with both the end of the riser and the top surface of the base tread, then the upper edge of the veneer overlay is trimmed so as to fit generally close to the lower surface of the overlying tread. This cut is not as critical since it will be concealed by the trim pieces described above. Following trimming, the adhesive protective backing is removed from the overlay and pressed onto the face of the riser, making certain that it aligns with both the end of the riser and the top surface of the base tread. This process is repeated at the opposite end of the riser.

The above description is considered that of the preferred embodiments only. Modification of the invention will occur to those skilled in the art and to those who make and use the invention. Therefore, it is understood that the embodiments shown in the drawings and described above are merely for illustrative purposes and are not intended to limit the scope of the invention, which is defined by the following claims.

The embodiments of the invention in which an exclusive property or privilege is claimed are defined as follows:

1. A method for making a stair step, comprising the steps of:

providing at least one stair tread having first and second opposing surfaces terminating in a plurality of edges;

providing at least one sheet of wood veneer, said sheet having at least one straight edge; and adhering said sheet of wood veneer to at least a portion of said first or second surface of said stair tread to cover at least one end of said stair tread and exposing a central portion of said stair tread.

2. The method as recited in claim 1, further comprising locating said stair tread on at least one stringer to define a step.

3. The method as recited in claim 2, further comprising attaching at least one riser to said stair tread proximate a rear edge of said stair tread thereby defining a reference line at an intersection of said riser with said stair tread.

4. The method as recited in claim 3, further comprising trimming said sheet of wood veneer so as to conform to at least one of said edges of said stair tread and to said reference line defined by said riser.

5. The method as recited in claim 4, further comprising attaching architectural trim pieces to said stair tread and riser to conceal unfinished edges or spaces.

6. The method as recited in claim 1, wherein the step of adhering said sheet of wood veneer to at least a portion of said stair tread includes aligning said at least one straight edge of said wood veneer with one edge of said stair tread; and providing an adhesive between said stair tread and said sheet of wood veneer to retain said sheet of wood veneer in place.

7. The method as recited in claim 6, wherein the step of providing said adhesive includes using a self-adhesive film applied to one surface of said wood veneer and protected by a peel-away sheet removed to adhere said sheet of wood veneer to said stair tread.

8. The method as recited in claim 1, wherein the step of providing at least one stair tread includes using a stair tread already secured to at least one stair stringer to define a stairway.

9. The method as recited in claim 5, wherein the step of attaching architectural trim pieces includes attaching architectural end caps to exposed ends of said stair tread.

10. A stair step, comprising:

a stair tread having upper and lower surfaces, a front edge, a back edge, and first and second ends; and first and second sheets of wood veneer adhered to said upper surface of said stair tread at said first and second ends and exposing a central portion of said upper surface.

11. The stair step as recited in claim 10, further comprising a riser extending downwardly from said stair tread proximate said from edge.

12. The stair step as recited in claim 11, further comprising at least one trim piece concealing a joint between said stair tread and riser.

13. The stair step as recited in claim 11, further comprising at least one end cap attached to at least one of said first and second ends of said stair tread.

14. The stair step as recited in claim 10, wherein said sheet of wood veneer includes a polymeric backing, and a film of adhesive on said polymeric backing for adhering said sheet of wood veneer to said stair tread.

15. A kit for applying wood veneer to a stair tread, comprising:

at least one precut sheet of wood veneer having at least one straight edge to be overlain and adhered to at least one end of an upper surface of a stair tread, said sheet specially configured and adapted so that said at least one straight edge is flush with one edge defined on said stair tread and extends over and covers an exposed end of the stair tread and exposing at least a central portion of said stair tread configured to be covered by a suitable floor covering such that it appears that said stair tread is made from architectural wood.

16. The kit as defined in claim 15, wherein said sheet of wood veneer includes an adhesive backing protected by a sheet removed prior to adhering said sheet to said stair tread.

17. The kit as defined in claim 16, further comprising precut strips of molding to be attached to said stair tread to conceal the boundaries of said veneer.

18. The kit as defined in claim 15, wherein said sheet of wood veneer is configured to cover a portion of said stair tread proximate an end.

19. The kit as defined in claim 15, further comprising a precut riser specially configured and adapted to interconnect successive treads.

20. The kit as defined in claim 15, further comprising at least one end cap to be attached to an exposed end of said stair tread.

21. The kit as defined in claim 19, wherein said riser includes a sheet of plywood having one veneered surface made from a species of wood which matches said at least one precut sheet of wood veneer.

22. A kit for making a stair step, comprising:

a base stair tread made from a wood composite and having predetermined dimensions, said base stair tread having opposing upper and lower surfaces, a back edge, a front edge, and first and second ends;

a riser made from a wood composite and precut to predetermined dimensions with a length generally equal to a length of said base stair tread;

at least one sheet of wood veneer precut to cover at least a portion of said upper surface, at least a portion of said front edge, and at least a portion of said lower surface of said base stair tread proximate at least one of said first and second ends and leaving a central portion of said base stair tread exposed to be covered by a suitable floor covering; and an adhesive deposited on one surface of said at least one sheet of wood veneer for attaching said wood veneer to said base stair tread.

23. The method as recited in claim 3, further including the steps of:

providing at least one sheet of wood veneer, said sheet having at least one straight edge; and adhering said sheet of wood veneer to at least a portion of a surface of said at least one riser such that said riser appears to be made from architectural wood.

24. The stair step as recited in claim 11, further including at least one sheet of wood veneer adhered to at least a portion of one surface of said riser such that said riser appears to be made from architectural wood.

25. The kit as defined in claim 19, wherein said sheet is configured to cover at least a portion of said precut riser.

26. A stair step, comprising:

a stair tread having upper and lower surfaces, a front edge, a back edge, and first and second ends; and first and second sheets of wood veneer, each of which is adhered to said upper surface at opposite ends of said stair tread and exposing a central portion of said stair tread, each sheet having one edge flush with an end of the stair tread and having another edge which wraps over and around a front edge of the stair tread.

* * * * *

UNITED STATES PATENT AND TRADEMARK OFFICE

CERTIFICATE OF CORRECTION

PATENT NO. : 5,531,048
DATED : July 2, 1996
INVENTOR(S) : Darling

It is certified that error appears in the above-indentified patent and that said Letters Patent is hereby corrected as shown below:

Col. 3, line 3, "rite" should be –the–;

Col. 4, line 18, after "support" (1st. occ.) insert --stringers. Each preferably retained in place by an adhesive applied to the--;

Col. 5, line 47, after "would" insert –be–;

Col. 5, line 60, "skin" should be –skirt–;

Col. 7, line 36, "coposite" should be –composite–; and

Col. 9, line 41, "claim 16" should be –claim 15–.

Signed and Sealed this

Twenty-fifth Day of February, 1997

*Attest:*

*Attesting Officer*

Bruce Lehman

BRUCE LEHMAN

*Commissioner of Patents and Trademarks*